US006488537B1

(12) United States Patent
Wittmer et al.

(10) Patent No.: US 6,488,537 B1
(45) Date of Patent: Dec. 3, 2002

(54) COUPLING OR PLUG FOR A LIQUID IMPERVIOUS PLUG CONNECTION

(75) Inventors: Detlev Wittmer, Maulbronn (DE); Wolfgang Babel, Weil der Stadt (DE)

(73) Assignee: Endress + Hauser Conducta Gesellschaft fur Mess — und Regeltechnik mbH + Co., Gerlingen (DE)

( * ) Notice: Subject to any disclaimer, the term of this patent is extended or adjusted under 35 U.S.C. 154(b) by 0 days.

(21) Appl. No.: 09/916,208

(22) Filed: Jul. 27, 2001

(30) Foreign Application Priority Data

Jul. 27, 2000 (DE) ..... 100 37 084

(51) Int. Cl.[7] ..... H01R 9/03
(52) U.S. Cl. ..... 439/610; 439/250
(58) Field of Search ..... 439/607–610, 439/108, 278–283, 271–277, 702–707, 578

(56) References Cited

U.S. PATENT DOCUMENTS

| | | | | |
|---|---|---|---|---|
| 4,786,260 A | * | 11/1988 | Spaulding | 439/607 |
| 5,127,843 A | | 7/1992 | Henry et al. | 439/320 |
| 5,743,765 A | | 4/1998 | Andrews et al. | 439/608 |
| 6,071,127 A | * | 6/2000 | Acke et al. | 439/63 |

FOREIGN PATENT DOCUMENTS

| | | |
|---|---|---|
| DE | G8808346.2 | 12/1989 |
| DE | 19751844 A1 | 7/1999 |

* cited by examiner

*Primary Examiner*—P. Austin Bradley
*Assistant Examiner*—Ross Gushi
(74) *Attorney, Agent, or Firm*—Jones, Tullar & Cooper, P.C.

(57) ABSTRACT

A contact plug for a fluid-tight plug connection is described, which is provided with shielding, in which a contact support is received. The shielding and the contact support are placed inside a housing. The shielding has a sleeve, which is provided with a shoulder.

5 Claims, 4 Drawing Sheets

COUPLING OR PLUG FOR A LIQUID IMPERVIOUS PLUG CONNECTION

FIELD OF THE INVENTION

The invention relates to a coupler or a contact plug for a fluid-tight plug connection, having a shielding in which a contact support is received, wherein the shielding and the contact support are placed inside a housing.

BACKGROUND OF THE INVENTION

Such a coupler, or such a contact, plug, are known from German Patent Application 197 23 684. The plug connection described therein is preferably intended for employment in measuring and environmental technologies. As a result of this, the plug connection must be designed to be fluid-tight. A further demand made on the plug connection consists in that it must be simple to produce and simple to operate for a user.

Moreover, in case of an accident, for example if the open coupler comes into contact with a fluid, or under other corresponding environmental conditions, no fluid should penetrate into the interior of the coupler.

OBJECT AND SUMMARY OF THE INVENTION

It is therefore an object of the invention to provide a fluid-tight plug connection which is further improved in respect to its manufacture and operation. The plug connection, or the coupler in particular, should be fluid-tight also in case of the mentioned accidents.

In connection with a coupler or a contact plug of the type mentioned at the outset, this object is attained in accordance with the invention by means of the characterizing features of the independent claims.

A limit stop for a component which is to be inserted into the coupler or the contact plug is provided by the shoulder in accordance with the invention, which is present in the sleeve. By means of this it is achieved that the position of the inserted component is exactly defined by the shoulder.

It is particularly advantageous if the shoulder is intended as a limit stop for a glass tube or the like. As already mentioned, the installed position of the glass tube in the contact plug or the coupler is exactly defined by this. Moreover, by means of this it is achieved that the window in the sleeve, which is arranged below the shoulder, can in no way be hidden by the glass tube. Because of this, the window can always be used for soldering the electrical cables which are to be connected through the window.

A solid and lasting connection between the two sleeves is achieved in a particularly simple manner by press-fitting them together in accordance with the invention. In this case this connection can be made constructively simple and cost-effectively.

It is particularly practical if the press-fit forms an electrical connection. By means of this it is achieved that the two sleeves form a shielding in a simple manner. No additional separate shielding is therefore required.

In a particularly advantageous manner it is achieved by means of the electrically conductive layer on the sleeve the sleeve can be used as shielding. Therefore no elaborate component for producing the shielding is required, the electrical layer in accordance with the invention on the sleeve is sufficient.

It is particularly advantageous if the sleeve is made of plastic or the like. In this way the sleeve can be produced particularly simply and cost-effectively, without its use as shielding being prevented by this. Thus, a plastic component with a shielding effect is made available by means of the invention.

Further characteristics, application options and advantages of the invention ensue from the following description of exemplary embodiments of the invention, which are represented in the drawing figures. Here, all described or represented characteristics, either by themselves or in any combination, constitute the subject of the invention, regardless of their combination in the claims or their dependencies, as well as independently of their wording, or representation, in the description, or in the drawings.

DETAILED DESCRIPTION OF THE PREFERRED EMBODIMENTS

A plug connection, which can be put together from a coupler 10 and a contact plug 30, is represented in FIGS. 1 to 4. The plug connection is designed to be fluid-tight and can be employed in connection with measuring technology, for example, in particular in connection with environmental technology. It is possible to connect a cable, for example, to a sensor by means of the plug connection. In this case the cable is connected to the coupler 10, and the sensor to the contact plug 30.

It is understood that the characteristics of the contact plug 30 described in what follows can also be provided for a coupler. Correspondingly, the characteristics of the coupler 10 described in what follows can also be employed in connection with a contact plug. Therefore the plug connector can also be employed for connecting two cables with each other. It is also possible to connect a sensor to the contact plug and a cable to the coupler.

Figure 1:
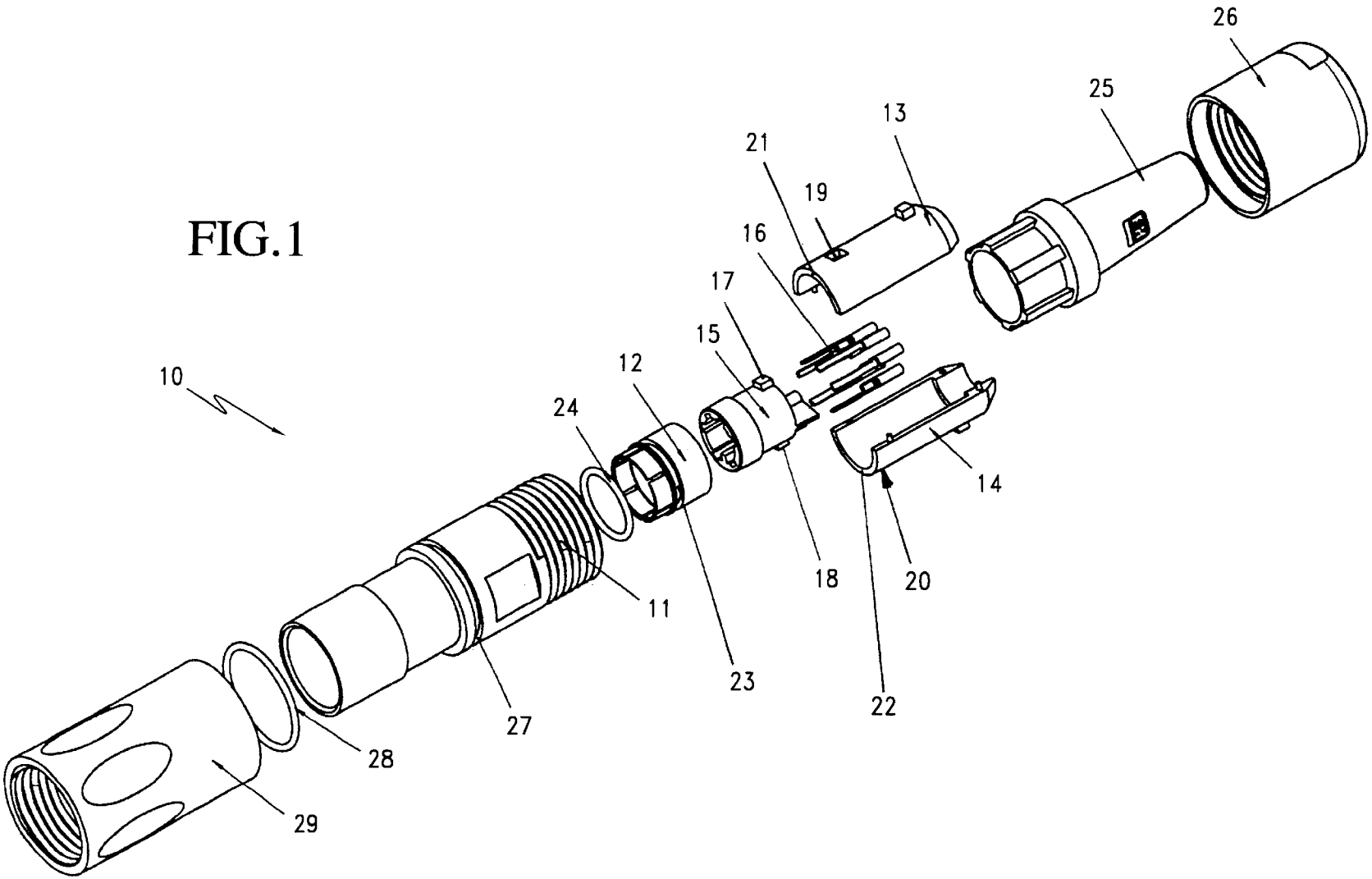
FIG. 1 is a schematic perspective representation of an exemplary embodiment of a coupler in accordance with the invention.
Figure 2:
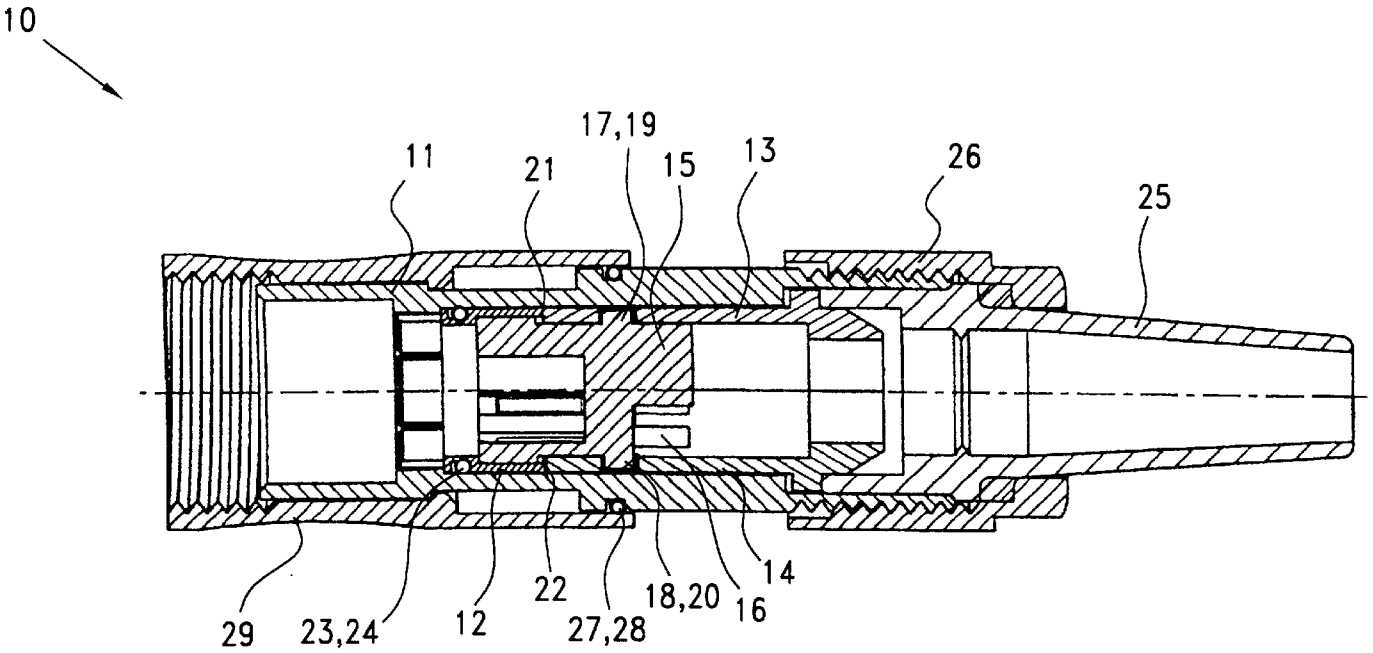
FIG. 2 is a schematic sectional representation of the coupler in FIG. 1.

The coupler 10 is represented in FIGS. 1 and 2. The coupler 10 is provided for having a cable connected with it. The coupler 10 is essentially designed to be axially symmetrical.

The coupler 10 has a housing 11, into which a shielding has been placed. The shielding is composed of a sleeve 12 and two half-shells 13, 14. A contact support 15 has been inserted into the sleeve 12. Contact pins 16 are housed in the contact support 15.

The sleeve 12 and the contact support 15 are essentially designed in a tube shape. The interior diameter of the sleeve 12 approximately corresponds to the exterior diameter of the contact support 15. The sleeve 12 is made from an electrically conductive metal. The contact support 15 consists of a electrically insulating and resilient plastic material, for example of polyfluoroalkoxy polymer (PFA). In the inserted and press-fitted state, the contact support 15 and the sleeve 12 rest intimately against each other. Because of the resilient plastic material employed, a fluid-tight connection between the sleeve 12 and the contact support 15 is therefore created.

Two protrusions 17, 18 extend away from two opposite sides of the contact support 15. Openings 19, 20 have been respectively cut into the half-shells 13, 14 and are assigned to the protrusions 17, 18. The half-shells 13, 14 have an interior radius corresponding to the exterior radius of the contact support 15. The half-shells 13, 14 can therefore be placed on the contact support 15. In the process, the protrusions 17, 18 of the contact support 15 engage cutouts 19, 20 in the half-shells 13, 14. A mechanical connection between the contact support 15 and the half-shells 13, 14 is created in this way.

The half-shells 13, 14 have been produced as injection-molded elements from plastic, for example. At least one of the surfaces of the half-shells 13, 14, for example the exterior faces, has been provided with an electrically conductive layer. The front faces 21, 22 of the half-shells 13, 14 facing the sleeve 12 have also been provided with an electrically conductive layer.

In the assembled state of the shielding, i.e. when the contact support 15 has been inserted into the sleeve 12, and when the half-shells 13, 14 have been placed on the contact support 15, the front faces 21, 22 of the half-shells 13, 14 rest against the sleeve 12. An electrical connection between the metallic sleeve 12 and the half-shells 13, 14 provided with the electrically conductive layer is created in this way.

The shielding consisting of the sleeve 12 and the half-shells 13, 14, including the contact support 15 housed therein, is placed into the housing 11. A groove 23, into which an annular seal 24 has been inserted, is provided on the exterior of the sleeve 12. The other side of the annular seal 24 rests against the inside of the housing 11. In this way a fluid-tight connection is created between the sleeve 12 and the housing 11.

The free ends of the half-shells 13, 14 facing away from the sleeve 12 have been inserted into an essentially tube-shaped cable socket 25. A nut 26, which can be screwed together with the housing 11, has been placed over the cable socket 25. In this way the shielding, consisting of the sleeve,12 and the half-shells 13, 14, including the contact support 15 housed therein, are solidly and fluid-tight housed in the interior of the housing 11.

The outer surface of the housing 11 is provided with a groove 27, into which an annular seal 28 has been inserted. A screw connection 29 has been placed on the housing 11, namely over the annular seal 28, by means of which the coupler 10 can be screwed together with the contact plug 30. The annular seal 28 prevents the accumulation of dirt in the annular gap between the housing 11 and the screw connection 29.

Figure 3:
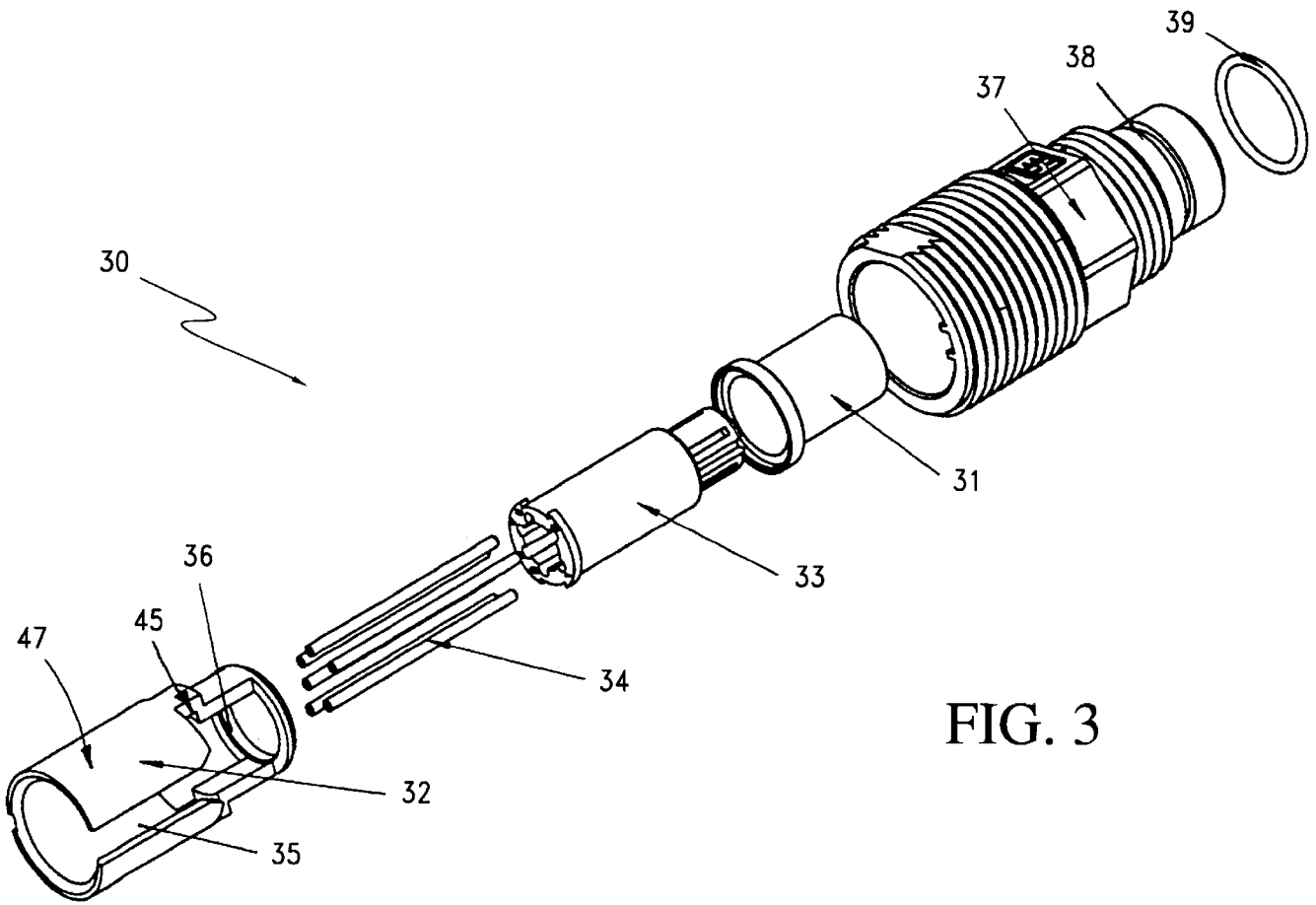
FIG. 3 is a schematic perspective representation of an exemplary embodiment of a contact plug in accordance with the invention.
Figure 4:
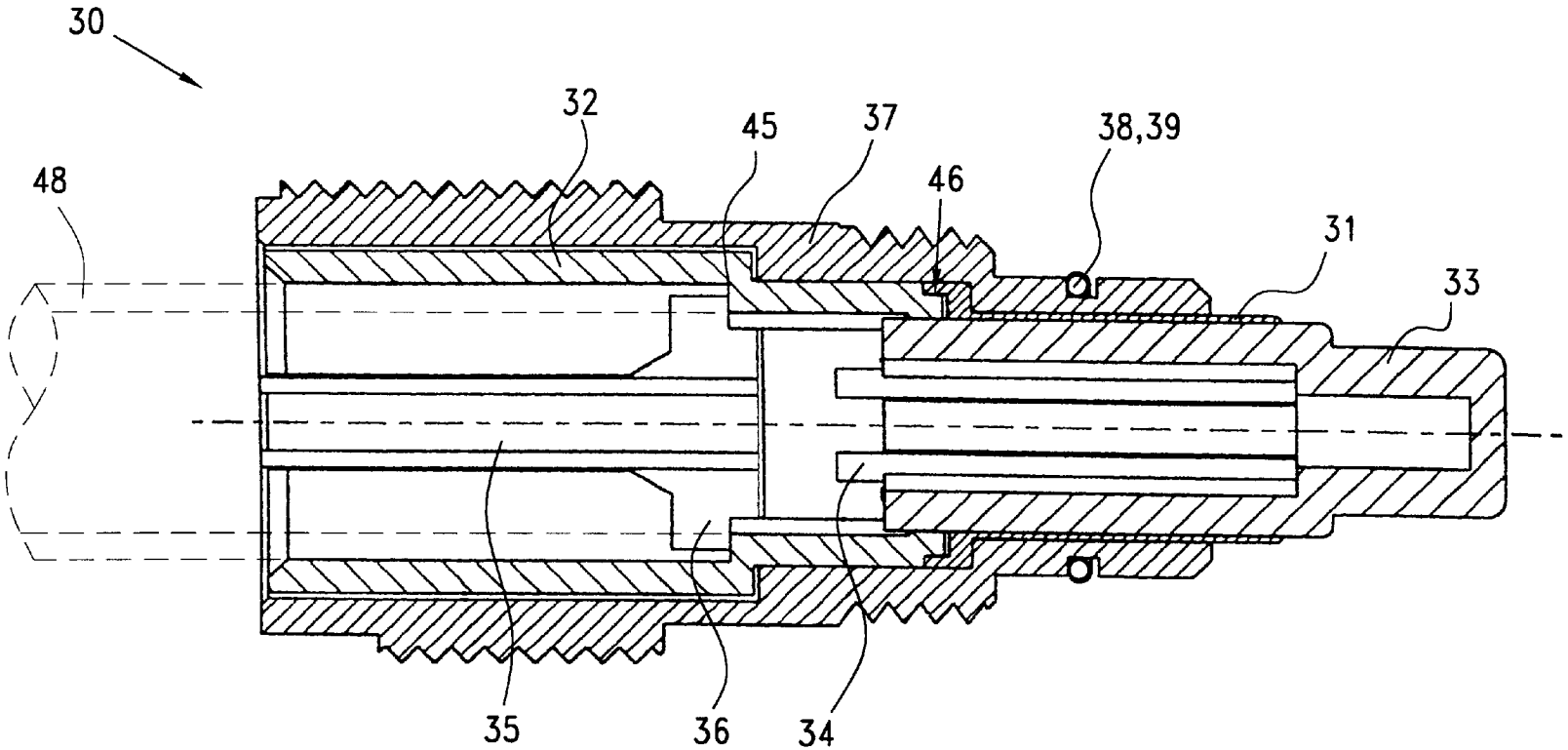
FIG. 4 is a schematic sectional representation of the contact plug in FIG. 3.

The contact plug 30 is represented in FIGS. 3 and 4. The contact plug 30 is intended to be connected with a sensor or the like. The contact plug 30 is designed to be essentially axially symmetrical.

The contact plug 30 has a shielding consisting of a first sleeve 31 and a second sleeve 32. On its free end facing the second sleeve 32, the first sleeve 31 has an inner diameter, which corresponds to the outer diameter of the facing free end of the second sleeve 32. At these facing free ends, the first sleeve 31 and the second sleeve 32 are press-fitted together (46). Therefore a solid mechanical connection exists between the first sleeve 31 and the second sleeve 32.

The first sleeve 31 is embodied to be tube-shaped. A contact support 33 is arranged in the interior of the first sleeve 31. The contact support 33 is used for receiving contact pins 34.

The first sleeve 31 is produced, for example as a rotating element, from an electrically conductive metal. The second sleeve is produced as an injection-molded element from plastic. The outside of the second sleeve 32 is provided with an electrically conductive layer 47. The second sleeve 32 has a slit 35 oriented in the longitudinal direction. The second sleeve 32 is furthermore provided with at least one window 36.

The two sleeves 31, 32 are electrically connected (47) with each other by the first sleeve 31 and the second sleeve 32 being press-fitted together. The already mentioned shielding is the result of all this.

The contact support 33 is made of an electrically insulating and resilient plastic material, for example of polyfluoroalkoxy polymer (PFA). The exterior diameter of the contact support 33 approximately corresponds to the interior diameter of the first sleeve 31. In this way the contact support 33 rests intimately against the first sleeve 31. Because of the resilient plastic material employed, a fluid-tight connection between the contact support 33 and the first sleeve 31 is thus created.

The longitudinal slit 35 is provided for the connection of the coupler 30 with the sensor. For example, it is possible for a glass tube of the sensor to be inserted into the sleeve 32. The slit 35 permits the compensation of diameter tolerances of the glass tube in order to assure secure clamping. It is possible alternatively or additionally to glue the glass tube of the sensor together with the sleeve 32, wherein the slit 35 then permits the filling with adhesive.

The sleeve 32 is provided with a shoulder 45 which, in accordance with FIG. 3 or FIG. 4, makes a transition from a larger to a narrower diameter in the direction toward the sleeve 31. In this way the shoulder 45 represents a limit stop for the glass tube which, in FIG. 3 or in FIG. 4, is inserted from the left into the sleeve 32.

The window 36 in the sleeve 32 is provided for making possible the electrical connection of the conductors of the sensor with the contact pins 34 of the contact support 33. To this end it is possible to solder the conductors from the sensor to the contact pins 34 through the window(s) 36. Because of the shoulder 45, the window 36 cannot be hidden by the inserted glass tube.

The shielding consisting of the first sleeve 31 and the second sleeve 32, including the contact support 33 housed therein, is placed into a housing 37. A groove 38, into which an annular seal 39 has been inserted, is provided on the exterior of the housing 37 facing away from the second sleeve 32.

The housing 37 is provided with an exterior screw thread, on which the screw connection 29 of the coupler 10 can be screwed. In the screwed-on state, the screw connection 29 is arranged over the annular seal 38. A fluid-tight connection between the screw connection 29 and the housing 37 is created in this way.

The coupler 10 is produced in the following manner, for example: first, the contact pins 16 are inserted into the contact support 15, and the contact support 15 is press-fitted into the sleeve 12. Then, the cable to be connected is passed through the cable socket 25 and the nut 26. The conductors of the cable to be connected can now be soldered to the contact pins 16. Furthermore, the half-shells 13, 14 are placed on the contact support 15. The contact support 15, together with the contact pins 16 and the conductors of the cable to be connected soldered to them therefore are located inside the shielding constituted by the sleeve 12 and the half-shells 13, 14. Now this shielding is inserted by the free ends of the half-shells 13, 14 into the cable socket 25 on the one hand, and on the other is pushed together with the sleeve 12 into the housing 11. Prior to that, the sealing ring 24 is pulled on the sleeve 12. Now the nut 26 is screwed to the exterior screw thread of the housing 11. Finally, the annular seal 28 is inserted into the groove 27 and the screw connection 29 is placed on the housing 11.

The contact plug 30 is produced in the following manner, for example: first, the contact pins 34 are inserted into the contact support 33. Then the contact support 33 is inserted into the first sleeve 31. The first sleeve 31 is subsequently press-fitted together with the second sleeve 32. It is now possible to insert the provided sensor into the second sleeve 32. The connecting lines of the inserted sensor can be soldered to the contact pins 34 through the window 36 of the second sleeve 32. Now the shielding, consisting of the first and second sleeves 31, 32, including the contact support 33 with the contact pins 34 and the connecting lines from the sensor soldered to them, can be pushed into the housing 37 and, if required, glued to it. The annular seal 39 is inserted into the groove 38 of the housing 37.

To connect the contact plug 30 and the coupler 10, the free end of the contact plug 30, together with the annular seal 39, is plugged into the screw connection 29 of the coupler 10. Thereafter the contact plug 30 and the coupler 10 are screwed together by means of the screw connection 29.

What is claimed is:

1. A coupler or contact plug for a fluid-tight plug connection, comprising:

a housing:

a first sleeve;

a second sleeve, said first sleeve and said second sleeve forming an engagement with each other in said housing; and a contact support, wherein:

said contact support is located inside said first sleeve; and said second sleeve is provided with a shoulder which forms a transition from a larger diameter to a narrower diameter in the direction toward said first sleeve.

2. The coupler or contact plug in accordance with claim 1, wherein said shoulder serves as a limit stop for a glass tube received by the coupler or contact plug.

3. The coupler or contact plug in accordance with claim 1, wherein said second sleeve includes a window, and wherein said shoulder is arranged above said window.

4. A coupler or contact plug for a fluid-tight plug connection, comprising:

a housing;

a first sleeve;

a second sleeve, said first sleeve and said second sleeve forming an engagement with each other in said housing; and a contact support, wherein:

said contact support is located inside said first sleeve;

said second sleeve comprises plastic including an electrically conductive layer, and said first sleeve and said second sleeve forming said engagement as a result of both being press-fit against each other.

5. The coupler or contact plug in accordance with claim 4, wherein the press-fit constitutes an electrical connection.

* * * * *